US006261327B1

(12) United States Patent
Graham et al.

(10) Patent No.: US 6,261,327 B1
(45) Date of Patent: Jul. 17, 2001

(54) ADDITIVE CONCENTRATES FOR RAPIDLY REDUCING OCTANE REQUIREMENT

(75) Inventors: Joseph Graham, Wirral (GB); Robert Peter Aiello; Earl Jon Haury, both of Houston, TX (US)

(73) Assignee: Shell Oil Company, DE (US)

( * ) Notice: Subject to any disclaimer, the term of this patent is extended or adjusted under 35 U.S.C. 154(b) by 0 days.

(21) Appl. No.: 09/085,778

(22) Filed: May 28, 1998

Related U.S. Application Data

(60) Provisional application No. 60/047,900, filed on May 29, 1997.

(51) Int. Cl.[7] ..... C10L 1/22

(52) U.S. Cl. ..... 44/338; 44/329; 44/340; 44/347; 44/415; 44/418; 44/432; 44/387

(58) Field of Search ..... 44/338, 340

(56) References Cited

U.S. PATENT DOCUMENTS

| | | | |
|---|---|---|---|
| 3,136,766 | 6/1964 | Buc et al. | 260/247.7 |
| 3,155,464 | 11/1964 | Woodruff | 44/63 |
| 3,438,757 | 4/1969 | Honnen et al. | 44/58 |
| 3,574,576 | 4/1971 | Honnen et al. | 44/72 |
| 3,753,670 | 8/1973 | Strang et al. | 44/72 |
| 3,756,793 | 9/1973 | Robinson | 44/62 |
| 4,155,718 | 5/1979 | Graiff | 44/58 |
| 4,160,648 | 7/1979 | Lewis et al. | 44/63 |
| 4,191,537 | 3/1980 | Lewis et al. | 44/71 |
| 4,198,206 | 4/1980 | Ryan | 23/230 |
| 4,231,759 | 11/1980 | Udelhofen et al. | 44/75 |
| 4,236,020 | 11/1980 | Lewis et al. | 560/159 |
| 4,247,301 | 1/1981 | Honnen | 44/63 |
| 4,270,930 | 6/1981 | Campbell et al. | 44/71 |
| 4,288,612 | 9/1981 | Lewis et al. | 560/159 |
| 4,332,595 | 6/1982 | Herbstman et al. | 44/72 |
| 4,397,750 | 8/1983 | Chibnik | 252/51.5 A |
| 4,409,001 | 10/1983 | Sung et al. | 44/71 |
| 4,477,261 | 10/1984 | Sung et al. | 44/63 |
| 4,486,573 | 12/1984 | Hayashi | 525/285 |
| 4,505,717 | 3/1985 | Sung | 44/53 |
| 4,521,330 | 6/1985 | Olstowski et al. | 252/51.5 |
| 4,548,616 | 10/1985 | Sung et al. | 44/77 |
| 4,581,040 | 4/1986 | Sung et al. | 44/71 |
| 4,604,102 | 8/1986 | Zaweski et al. | 44/57 |
| 4,612,335 | 9/1986 | Cuscurida et al. | 521/167 |
| 4,643,737 | 2/1987 | Sung et al. | 44/63 |
| 4,643,738 | 2/1987 | Sung et al. | 44/63 |
| 4,659,336 | 4/1987 | Sung et al. | 44/62 |
| 4,696,755 | 9/1987 | Campbell | 252/515 |
| 4,698,412 | 10/1987 | Tracy et al. | 528/323 |
| 4,747,851 | 5/1988 | Sung et al. | 44/72 |
| 4,758,363 | 7/1988 | Sung et al. | 252/51.5 |
| 4,760,152 | 7/1988 | Tracey et al. | 548/551 |
| 4,801,400 | 1/1989 | Login et al. | 252/357 |
| 4,806,609 | 2/1989 | Tracy et al. | 526/264 |
| 4,810,261 | 3/1989 | Sung et al. | 44/62 |
| 4,830,851 | 5/1989 | Tracy et al. | 424/78 |
| 4,852,993 | 8/1989 | Sung et al. | 44/62 |
| 4,869,728 | 9/1989 | Sung | 44/71 |
| 4,881,945 | 11/1989 | Buckley, III | 44/72 |
| 4,883,826 | 11/1989 | Marugg et al. | 521/164 |
| 4,936,868 | 6/1990 | Johnson | 44/71 |
| 4,958,032 | 9/1990 | O'Lenick, Jr. | 548/543 |
| 4,968,321 | 11/1990 | Sung et al. | 44/337 |
| 4,973,414 | 11/1990 | Nerger et al. | 252/52 |
| 4,975,096 | 12/1990 | Buckley, III | 44/433 |
| 4,975,159 | 12/1990 | Dahms | 204/15 |
| 4,981,493 | 1/1991 | Sung | 44/331 |
| 4,983,384 | 1/1991 | O'Lenick, Jr. | 424/70 |
| 4,985,047 | 1/1991 | Sung et al. | 44/433 |
| 4,992,187 | 2/1991 | Adams et al. | 252/50 |
| 5,028,719 | 7/1991 | O'Lenick, Jr. | 548/544 |
| 5,034,143 | 7/1991 | O'Lenick, Jr. | 252/51.5 |
| 5,061,291 | 10/1991 | Sung | 44/347 |
| 5,123,932 | 6/1992 | Rath et al. | 44/303 |
| 5,141,524 | 8/1992 | Gonzalez | 44/340 |
| 5,147,414 | 9/1992 | Powers, III et al. | 44/347 |
| 5,352,251 * | 10/1994 | Lin et al. | 44/340 |
| 5,458,660 * | 10/1995 | Lin et al. | 44/340 |
| 5,507,843 * | 4/1996 | Lin et al. | 44/329 |
| 5,837,867 * | 11/1998 | Lin et al. | 44/329 |

FOREIGN PATENT DOCUMENTS

| | | |
|---|---|---|
| 106400 | 7/1973 | (DE) . |
| 0330614 | 8/1989 | (EP) . |

* cited by examiner

*Primary Examiner*—Ellen M. McAvoy

(57) ABSTRACT

The present invention is directed to an additive concentrate for reducing octane requirement comprising a cyclic amide alkoxylate compound of the formula I:

(I)

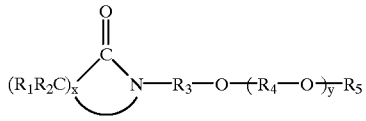

wherein x is from 3 to 11; y is from 1 to 50; $R_1$ and $R_2$ are each independently hydrogen, hydrocarbyl of 1 to 100 carbon atoms and substituted hydrocarbyl of 1 to 100 carbon atoms; $R_3$ is hydrocarbyl of 1 to 100 carbon atoms or substituted hydrocarbyl of 1 to 100 carbon atoms; each $R_4$ is independently hydrocarbyl of 2 to 100 carbon atoms or substituted hydrocarbyl of 2 to 100 carbon atoms; $R_5$ is hydrogen, hydrocarbyl of 1 to 100 carbon atoms, substituted hydrocarbyl of 1 to 100 carbon atoms or acyl of 1 to 20 carbon atoms; a detergent selected from polyalkenylamines, Mannich amines, polyalkenylsuccinimides, poly (oxyalkylene) carbamates and poly(alkenyl)-N-substituted carbamates and an optional solvent. The present invention is further directed to a gasoline composition comprising hydrocarbons in the gasoline boiling range and said gasoline additive concentrate and to a process for reducing octane requirement utilizing said gasoline additive concentrate.

21 Claims, No Drawings

ADDITIVE CONCENTRATES FOR RAPIDLY REDUCING OCTANE REQUIREMENT

This application claims the benefit of U.S. Provisional Application No. 60/047,900, filed May 29, 1997, the entire disclosure of which is hereby incorporated by reference.

FIELD OF THE INVENTION

The present invention relates to a gasoline additive concentrate for rapidly reducing octane requirement comprising a cyclic amide alkoxylate compound, a detergent and an optional solvent. The present invention further relates to a gasoline composition comprising hydrocarbons in the gasoline boiling range and said gasoline additive concentrate and a process for rapidly reducing octane requirement using said gasoline additive concentrate.

BACKGROUND OF THE INVENTION

The octane requirement increase effect exhibited by internal combustion engines, e.g., spark ignition engines, is well known in the art. This effect may be described as the tendency for an initially new or relatively clean engine to require higher octane quality fuel as operating time accumulates, and is coincidental with the formation of deposits in the region of the combustion chamber of the engine.

During the initial operation of a new or clean engine, a gradual increase in octane requirement, i.e., fuel octane number required for knock-free operation, is observed with an increasing build up of combustion chamber deposits until a stable or equilibrium octane requirement level is reached. This level appears to correspond to a point in time when the quantity of deposit accumulation on the combustion chamber and valve surfaces no longer increases but remains relatively constant. This so-called "equilibrium value" is normally reached between 3,000 and 20,000 miles or corresponding hours of operation. The actual equilibrium value of this increase can vary with engine design and even with individual engines of the same design; however, in almost all cases, the increase appears to be significant, with octane requirement increase values ranging from about 2 to about 10 research octane numbers being commonly observed in modern engines.

The accumulation of deposits on the intake valves of internal combustion engines also presents problems. The accumulation of such deposits is characterized by overall poor driveability including hard starting, stalls, and stumbles during acceleration and rough engine idle.

Many additives are known which can be added to hydrocarbon fuels to prevent or reduce deposit formation, or remove or modify formed deposits, in the combustion chamber and on adjacent surfaces such as intake valves, ports, and spark plugs, which in turn causes a decrease in octane requirement.

Continued improvements in the design of internal combustion engines, e.g., fuel injection and carburetor engines, bring changes to the environment of such engines thereby creating a continuing need for new additives to control the problem of inlet system deposits and to improve driveability which is usually related to deposits.

It would be an advantage to have an additive concentrate which produces a rapid and substantial octane requirement reduction response.

SUMMARY OF THE INVENTION

The present invention is directed to an additive concentrate for rapidly reducing octane requirement comprising a cyclic amide alkoxylate compound of the formula I:

(I)

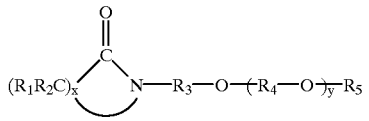

wherein x is from 3 to 11; y is from 1 to 50; $R_1$ and $R_2$ are each independently hydrogen, hydrocarbyl of 1 to 100 carbon atoms and substituted hydrocarbyl of 1 to 100 carbon atoms; $R_3$ is hydrocarbyl of 1 to 100 carbon atoms or substituted hydrocarbyl of 1 to 100 carbon atoms; each $R_4$ is independently hydrocarbyl of 2 to 100 carbon atoms or substituted hydrocarbyl of 2 to 100 carbon atoms; $R_5$ is hydrogen, hydrocarbyl of 1 to 100 carbon atoms, substituted hydrocarbyl of 1 to 100 carbon atoms or acyl of 1 to 20 carbon atoms; a detergent selected from polyalkenylamines, Mannich amines, polyalkenylsuccinimides, poly (oxyalkylene) carbamates and poly(alkenyl)-N-substituted carbamates and an optional solvent. The present invention is further directed to a gasoline composition comprising hydrocarbons in the gasoline boiling range and said gasoline additive concentrate and to a process for reducing octane requirement utilizing said gasoline additive concentrate.

DESCRIPTION OF THE PREFERRED EMBODIMENTS

The additive concentrate of the present invention comprises a "mega-dose" of a cyclic amide alkoxylate combined with a detergent selected from polyalkenylamines, Mannich amines, poyalkenylsuccinimides, poly(oxyalkylene) carbamates and poly (alkenyl)-N-substituted carbamates and an optional solvent. Such additive concentrates are typically utilized as an aftermarket product (added by the consumer directly to the gas tank prior to the addition of gasoline) but may be utilized for the bulk treatment of gasoline prior to being dispensed at the fuel pumps. By using this additive concentrate at "mega-dose" levels, a substantial reduction in octane requirement over a short or rapid time period is obtained. As used herein, the term "mega-dose" means the amount of cyclic amide alkoxylate used to treat gasoline, so that the final dosage of the cyclic amide alkoxylate in the gasoline is greater than 1000 ppm (parts per million) by weight based on the total weight of the gasoline composition.

The cyclic amide alkoxylate used in the present invention is disclosed in U.S. Pat. No. 5,352,251, incorporated herein by reference. The cyclic amide alkoxylate is of the Formula I:

(I)

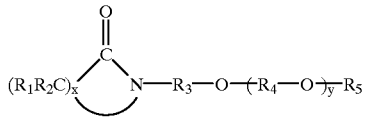

wherein x is from 3 to 11; y is from 1 to 50; $R_1$ and $R_2$ are each independently hydrogen, hydrocarbyl of 1 to 100 carbon atoms and substituted hydrocarbyl of 1 to 100 carbon atoms; $R_3$ is hydrocarbyl of 1 to 100 carbon atoms or substituted hydrocarbyl of 1 to 100 carbon atoms; each $R_4$ is independently hydrocarbyl of 2 to 100 carbon atoms or substituted hydrocarbyl of 2 to 100 carbon atoms; $R_5$ is hydrogen, hydrocarbyl of 1 to 100 carbon atoms, substituted hydrocarbyl of 1 to 100 carbon atoms or acyl of 1 to 20 carbon atoms.

As used herein, the term "hydrocarbyl" represents a radical formed by the removal of one or more hydrogen atoms from a carbon atom of a hydrocarbon (not necessarily the same carbon atom). Useful hydrocarbyls are aliphatic, aromatic, substituted, unsubstituted, acyclic or cyclic. Preferably, the hydrocarbyls are aryl, alkyl, alkenyl or cycloalkyl and are straight-chain or branched-chain. Representative hydrocarbyls include methyl, ethyl, butyl, pentyl, methylpentyl, hexenyl, ethylhexyl, dimethylhexyl, octamethylene, octenylene, cyclooctylene, methylcyclooctylene, dimethylcyclooctyl, isooctyl, dodecyl, hexadecenyl, octyl, eicosyl, hexacosyl, triacontyl and phenylethyl. When the hydrocarbyl is substituted, it contains a functional group such as carbonyl, carboxyl, nitro, amino, hydroxy (e.g. hydroxyethyl), oxy, cyano, sulfonyl, and sulfoxyl. The majority of the atoms, other than hydrogen, in substituted hydrocarbyls are carbon, with the heteroatoms (i.e., oxygen, nitrogen, sulfur) representing only a minority, 33% or less, of the total non-hydrogen atoms present.

For purposes of the present invention, $R_1$ and $R_2$ are preferably each selected from hydrogen and hydrocarbyl of 1 to 20 carbon atoms, especially hydrogen and alkyl of 1 to 20 carbon atoms, more preferably hydrogen and alkyl of 1 to 8 carbon atoms. In the most preferred embodiments of the present invention, $R_1$ and $R_2$ are each hydrogen.

In Formula I, x is from 3 to 11. For purposes of the present invention, particularly preferred compounds of Formula I are those in which x is 3, 5 or 11, especially 3 or 5.

$R_3$ is preferably hydrocarbyl of 1 to 20 carbon atoms, especially alkyl of 1 to 20 carbon atoms, more preferably $R_3$ is alkyl of 2 to 10 carbon atoms, and most preferably alkyl of 2 or 4 carbon atoms.

In Formula I, y is from 1 to 50, preferably from 8 to 40, and even more preferably from 18 to 24. Those of ordinary skill in the art will recognize that when the compounds of Formula I are utilized in a composition, y will not have a fixed value but will instead be represented by a range of different values. As used in this specification, y is considered to be a (number) average of the various values of y that are found in a given composition, which number has been rounded to the nearest integer.

Each $R_4$ is preferably independently hydrocarbyl of 2 to 20 carbon atoms, more preferably of 2 to 14 carbon atoms and most preferably 2 to 4 carbon atoms.

Particularly preferred compounds of Formula I are those in which $R_4$ is hydrocarbyl (geminal or vicinal) of the formula:

(II)

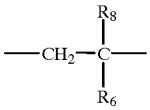

or (III)

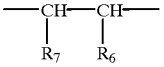

wherein $R_6$, $R_7$ and $R_8$ are each independently hydrogen, hydrocarbyl of 1 to 98 carbon atoms and substituted hydrocarbyl of 1 to 98 carbon atoms. Preferred $R_6$, $R_7$ and $R_8$ groups are hydrogen or hydrocarbyl of 1 to 18 carbon atoms. $R_7$ and $R_6$, or alternatively $R_6$ and $R_8$, may be taken together to form a divalent linking hydrocarbyl group of 3 to 12 carbon atoms.

The most preferred cyclic amide alkoxylate of the present invention are those in which $R_4$ is hydrocarbyl as represented by Formula II above in which $R_8$ is hydrogen and $R_6$ is independently hydrogen or alkyl of 1 to 18 carbon atoms, particularly those compounds where $R_8$ is hydrogen and $R_6$ is independently hydrogen or alkyl of 1 to 2 carbon atoms, especially those compounds where $R_8$ is hydrogen and $R_6$ is alkyl of two carbon atoms.

When y is greater than 1, the individual $R_4$'s are the same or different. For example, if y is 20, each $R_4$ can be alkyl of four carbon atoms. Alternatively, the $R_4$'s can differ and for instance, independently be alkyl from two to four carbon atoms. When the $R_4$'s differ, they may be present in blocks, i.e., all y groups in which $R_4$ is alkyl of three carbon atoms will be adjacent, followed by all y groups in which $R_4$ is alkyl of two carbon atoms, followed by all y groups in which $R_4$ is alkyl of four carbon atoms. When the $R_4$'s differ, they may also be present in any random distribution.

In the present invention, $R_5$ is preferably hydrogen, hydrocarbyl of 1 to 100 carbon atoms or acyl of 1 to 20 carbon atoms. Preferably, $R_5$ is hydrogen.

The cyclic amide alkoxylates of the present invention have a total weight average molecular weight of at least 600. Preferably, the total weight average molecular weight is from about 800 to about 4000, even more preferably from about 1000 to about 2000.

The cyclic amide alkoxylates are prepared by any of the methods known or disclosed in the art, including those set forth in U.S. Pat. No. 5,352,251. The compounds are illustratively prepared by reacting an initiator selected from cyclic amidoalcohols or cyclic amides with one or more epoxides in the presence of a potassium compound.

In a typical preparation of Formula I compounds, the one or more epoxides and initiator are contacted at a ratio from about 7:1 to about 55:1 moles of epoxide per mole of initiator. Preferably, they are contacted at a molar ratio from about 10:1 to about 30:1, with the most preferred molar ratio being about 20:1.

The reaction is carried out in the presence of potassium compounds which act as alkoxylation catalysts. Such catalysts are conventional and include potassium methoxide, potassium ethoxide, potassium hydroxide, potassium hydride and potassium-t-butoxide.

The manner in which the alkoxylation reaction is conducted is not critical to the invention. Alkoxylation processes of the above type are known and are described, for example in U.S. Pat. Nos. 4,973,414, 4,883,826, 5,123,932 and 4,612,335, each incorporated herein by reference.

The additive concentrate also contains a detergent selected from polyalkenylamines, Mannich amines, polyalkenylsuccinimides, poly(oxyalkylene) carbamates or poly(alkenyl)-N-substituted carbamates.

The polyalkylenylamine detergent utilized comprises at least one monovalent hydrocarbon group having at least 50 carbon atoms and at least one monovalent hydrocarbon group having at most five carbon atoms bound directly to separate nitrogen atoms of a diamine. Preferred polyalkenyl amines are polyisobutenylamines. Polyisobutenylamines are known in the art and representative examples are disclosed in various U.S. Patents numbers including U.S. Pat. Nos. 3,753,670, 3,756,793, 3,574,576, and 3,438,757, each incorporated herein by reference. Particularily preferred polyisobutenylamines for use in the present fuel composition include N-polyisobutenyl-N',N'-dimethyl-1,3-diaminopropane (PIB-DAP) and polyisobutenylethylenediamine (PIB-EDA).

The Mannich amine detergents utilized comprise a condensation product of a high molecular weight alkyl-substituted hydroxyaromatic compound, an amine which contains an amino group having at least one active hydrogen atom (preferably a polyamine), and an aldehyde. Such Mannich amines are known in the art and are disclosed in U.S. Pat. No. 4,231,759, incorporated herein by reference. Preferably, the Mannich amine is an alkyl substituted Mannich amine.

The polyalkenylsuccinimide detergents comprise the reaction product of a dibasic acid anhydride with either a polyoxyalkylene diamine, a hydrocarbyl polyamine or mixtures of both. Typically the succinamide is substituted with the polyalkenyl group but the polyalkenyl group may be found on the polyoxyalkylene diamine or the hydrocarbyl polyamine. Polyalkenylsuccinimides are also known in the art and representative examples are disclosed in various U.S. Patents including U.S. Pat. Nos. 4,810,261, 4,852,993, 4,968,321, 4,985,047, 5,061,291 and 5,147,414, each incorporated herein by reference.

The poly(oxyalkylene) carbamate detergents comprise an amine moiety and a poly(oxyalkylene) moiety linked together through a carbamate linkage, i.e.,

—O—C(O)—N—

These poly(oxyalkylene) carbamates are known in the art and representative examples are disclosed in various U.S. Patents including, U.S. Pat. Nos. 4,191,537, 4,160,648, 4,236,020, 4,270,930, 4,288,612 and 4,881,945, each incorporated herein by reference. Particularly preferred poly (oxyalkylene) carbamates for use in the present fuel composition include OGA-480 (a poly(oxyalkylene) carbamate which is available commercially from Oronite).

The poly(alkenyl)-N-substituted carbamate detergents utilized are of the formula:

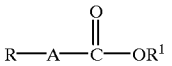

in which R is a poly(alkenyl) chain; $R^1$ is a hydrocarbyl or substituted hydrocarbyl group; and A is an N-substituted amino group. Poly(alkenyl)-N-substituted carbamates are known in the art and are disclosed in U.S. Pat. No. 4,936,868, incorporated herein by reference.

In the more preferred embodiments of the present invention, the detergent is selected from PIB-EDA and poly(oxyalkylene) carbamate. When PIB-EDA is used, the PIB-EDA can be prepared by any of the methods known and used in the art, including, but not limited to U.S. Pat. Nos. 5,346,965 and 5,583,186, each incorporated herein by reference. Polyisobutenyl-ethylenediamine is also commercially available from a variety of sources including Ferro Corporation and Oronite (as OGA-472). When PIB-EDA is used, the number average molecular weight is preferably from 900 to 2000, more preferably 950–1600. In the most preferred embodiments, the number average molecular weight is approximately 1150.

The additive concentrate optionally contains one or more solvents selected from aromatic solvents, paraffinic solvents, naphthenic solvents or mixtures thereof. Preferably, those solvents having a flashpoint greater than 140° F. flashpoint are used in the aftermarket products. The type of solvent used in not critical to the invention since the solvent merely functions as a carrier for easier handling and dispensing of the product from a bottle or other container. A variety of solvents which may be used in the present invention are also available commercially. Illustrative examples of the solvents which may be used in the present invention include, but are not limited to, CycloSol 150 and Shell Sol 142 HT (each commercially available from Shell Chemical Company), Exxsol D 110 and Exxon Aromatic 200 solvents (each commercially available from Exxon Chemical Company).

The manner in which the components of the additive concentrate are blended together is not critical to the invention. The components may be mixed utilizing any mixing apparatus known in the art. For example, the components may be mixed batchwise or by using an inline mixer. The components may be mixed all at once or the solvent and detergent may be mixed followed by the addition of the cyclic amide alkoxylate compound.

The amount of each component used will depend upon the final treatment rate or dosage desired. The ratio of alkoxylate compound:detergent will typically range from 1:1.1 to 60:1, with the more preferred range being 3.4:1 to 32:1. The amount of solvent used will be the amount needed to give concentrate which readily flows from the container it is in to allow ease for the consumer in dispensing the concentrate into the gas tank. The final amount of concentrate, once dispensed will give a ppm (parts per million) by weight based on the total weight of the fuel composition for the cyclic amide alkoxylate greater than 1000 ppm by weight, preferably 1100 to 6000 ppm by weight, based on the total fuel composition and for the detergent of 100 to 1000 ppm by weight based on the total fuel composition.

Particularily preferred embodiments of the present invention comprise an additive concentrate comprising the cyclic amide alkoxylate of formula I in which $R_1$ and $R_2$ are each hydrogen, $R_3$ is alkyl of 2 carbon atoms, $R_4$ is alkyl of 2 to 4 carbon atoms, $R_5$ is hydrogen, x is 3 or 5 and y is from 8 to 40; a detergent selected from PIB-EDA and poly (oxyalkylene) carbamate and an optional solvent and also a gasoline composition comprising this additive concentrate.

Fuel Compositions

The present invention further relates to a gasoline composition which is burned or combusted in internal combustion engines. The fuel composition of the present invention comprises a major amount of a mixture of hydrocarbons in the gasoline boiling range and said additive concentrate.

Suitable liquid hydrocarbon fuels of the gasoline boiling range are mixtures of hydrocarbons having a boiling range of from about 25° C. to about 232° C., and comprise mixtures of saturated hydrocarbons, olefinic hydrocarbons and aromatic hydrocarbons. Preferred are gasoline mixtures having a saturated hydrocarbon content ranging from about 40% to about 80% by volume, an olefinic hydrocarbon content from 0% to about 30% by volume and an aromatic hydrocarbon content from about 10% to about 60% by volume. The base fuel is derived from straight run gasoline, polymer gasoline, natural gasoline, dimer and trimerized olefins, synthetically produced aromatic hydrocarbon mixtures, or from catalytically cracked or thermally cracked petroleum stocks, and mixtures of these. The hydrocarbon composition and octane level of the base fuel are not critical. The octane level, (R+M)/2, will generally be above about 85.

Any conventional motor fuel base can be employed in the practice of the present invention. For example, hydrocarbons in the gasoline can be replaced by up to a substantial amount of conventional alcohols or ethers, conventionally known for use in fuels. The base fuels are desirably substantially free of water since water could impede a smooth combustion.

Normally, the hydrocarbon fuel mixtures to which the invention is applied are substantially lead-free, but may contain minor amounts of blending agents such as methanol, ethanol, ethyl tertiary butyl ether, methyl tertiary butyl ether, and the like, at from about 0.1% by volume to about 15% by volume of the base fuel, although larger amounts may be utilized. The fuels can also contain conventional additives including antioxidants such as phenolics, e.g., 2,6-di-tert-butylphenol or phenylenediamines, e.g., N,N'-di-sec-butyl-p-phenylenediamine, dyes, metal deactivators, dehazers such as polyester-type ethoxylated alkylphenol-formaldehyde resins. Corrosion inhibitors, such as a polyhydric alcohol ester of a succinic acid derivative having on at least one of its alpha-carbon atoms an unsubstituted or substituted aliphatic hydrocarbon group having from 20 to 500 carbon atoms, for example, pentaerythritol diester of polyisobutylene-substituted succinic acid, the polyisobutylene group having an average molecular weight of about 950, in an amount from about 1 ppm by weight to about 1000 ppm by weight, may also be present. The fuels can also contain antiknock compounds such as methyl cyclopentadienylmanganese tricarbonyl and ortho-azidophenol as well as co-antiknock compounds such as benzoyl acetone.

The amount of additive concentrate used will depend on the type and amount of performance desired. The cyclic amide alkoxylate will be present in an amount greater than 1000 ppm by weight, especially from 1100 ppm by weight to 6000 ppm by weight based on the total weight of the fuel composition. In the more preferred embodiments, the amount of cyclic amide alkoxylate present will range from 2400 ppm by weight to 4800 ppm by weight based on the total weight of the fuel composition.

The detergent is present in an amount from 100 ppm by weight to 1000 ppm by weight based on the total weight of the fuel composition, especially from 150 ppm by weight to 900 ppm by weight based on the total weight of the fuel composition. In the more preferred embodiment, when detergent is present, it is present in an amount from 150 to 700 ppm by weight based on the total weight of the fuel composition.

As noted above, the amount of solvent utilized in the additive concentrate will be the amount necessary to allow ease in dispensing the cyclic amide alkoxylate and detergent from the bottle or container. For example, the aftermarket products will contain from 10 to 20 ounces of a combination of cyclic amide alkoxylate, detergent and solvent since the aftermarket products are typically packaged in this manner.

The additive concentrate may optionally be added to the gasoline without the aid of solvent.

Engine Tests-Reduction of Octane Requirement

The invention still further provides a process for rapidly reducing octane requirement in engines utilizing the additive concentrate of the present invention. The process comprises supplying to and combusting or burning in an internal combustion engine a fuel composition comprising hydrocarbons in the gasoline boiling range and said additive concentrate as described hereinbefore.

Octane requirement reduction is the reduction of the octane requirement of an engine by the action of a particular gasoline, usually measured as a decrease from a stabilized octane requirement condition.

Octane requirement reduction is a performance feature that demonstrates a reduction from the established octane requirement of a baseline gasoline in a given engine. For purposes of Octane Requirement Reduction testing, baseline gasoline may or may not contain an additive package. Octane requirement reduction testing consists of operating an engine, which has achieved stable octane requirement using baseline gasoline, on a test gasoline for approximately 100 hours. Octane measurements are typically made daily and octane requirement reduction is a reduction of octane requirement from that of baseline gasoline. For rapid octane requirement reduction, measurements are taken approximately every 4 hours. Several octane requirement reduction tests may be conducted in a series for fuel to fuel comparison, or test fuel to baseline fuel comparison, by restabilizing on base fuel between octane requirement reduction tests.

The contribution of specific deposits is determined by removing deposits of interest and remeasuring octane requirement immediately after the engine is warmed to operating temperature. The octane requirement contribution of the deposit is the difference in ratings before and after deposit removal.

The invention will be described by the following examples which are provided for illustrative purposes and are not to be construed as limiting the invention.

EXAMPLES

Compound Preparations

The cyclic amide alkoxylates used in the following examples were prepared by reacting an initiator with one or more epoxides in the presence of a potassium compound to produce compounds of Formula I.

Compound A

To a clean, 2 gallon autoclave reactor equipped with heating, cooling and stirring means was added N-(2-hydroxyethyl)-pyrrolidinone (338 g) and KOH (6.08 g in 6.80 g water). The reactor was sealed and pressured/depressured with nitrogen to remove air and oxygen (50 psi 7 times). While stirring, the contents were heated to 110° C. under vacuum for 2 hours to dissolve the KOH and remove water. The pressure was then adjusted to 16 psi pressure with nitrogen and the contents heated to 130° C. To the mixture was then added 1,2-epoxybutane (3,380 g) over 13 hours (pressure during this time varied between 40 and 60 psi). After 1,2-epoxybutane was added, the temperature of the reaction contents was held at 130° C. with stirring for 4 hours to ensure complete reaction. The reactor was cooled to 80° C. and 76 g of magnesium silicate was added to adsorb the KOH catalyst. The temperature was then raised to 110° C. and the mixture was stirred for 30 minutes. The reactor contents were then cooled to 60° C. and the product removed. The slurry was filtered to remove solid particles. 3495 g of product having an average molecular weight of 1331 (ASTM D4274) and a kinematic viscosity of 196 centistokes at 100° F. (ASTM D445) was obtained.

Compound B

To a clean, 2 gallon autoclave reactor equipped with heating, cooling and stirring means was added δ-caprolactam (474 g) and KOH (7.13 g in 7.13 g water). The reactor was sealed and pressured/depressured with nitrogen to remove air and oxygen (50 psi 7 times). While stirring, the contents were heated to 110° C. under vacuum for 2 hours to melt the δ-caprolactam, dissolve the KOH and remove water. The pressure was then adjusted to 16 psi pressure with nitrogen and the contents heated to 130° C. To the mixture was then added 1,2-epoxybutane (5,405 g) over 14 hours (pressure during this time varied between 40 and 60 psi). After 1,2-epoxybutane was added, the temperature of the reaction contents was held at 130° C. with stirring for 4 hours to ensure complete reaction. The reactor was cooled to 80° C. and 82 g of magnesium silicate was added to adsorb the KOH catalyst. The temperature was then raised to 110° C. and the mixture was stirred for 30 minutes. The reactor contents were then cooled to 60° C. and the product removed. The slurry was filtered to remove solid particles. 5307 g of product having an average molecular weight of 1338 (ASTM D4274) and a kinematic viscosity of 213 centistokes at 100° F. (ASTM D445) was obtained.

Test Results

In each of the following tests, the baseline fuel utilized comprised either premium unleaded gasoline (PU) (90+ octane, [R+M/2]) and/or regular unleaded gasoline (RU) (85–88 octane, [R+M/2]) each which contained PIB-EDA+ carrier fluid at 100 ptb. Those skilled in the art will recognize that fuels containing heavy catalytically cracked stocks, such as most regular fuels, are typically more difficult to additize in order to effectuate octane requirement reduction. A variety of formulations were prepared for testing purposes by merely adding the neat cyclic amide alkoxylate compound and detergent to the gasoline in a mixing vessel using a recirculation pump. Preparations of the cyclic amide alkoxylate compounds utilized (Compound A or Compound B) are described above. The PIB-EDA utilized was approximately 1150 MW product obtained from Ferro Corporation. The OGA-480 utilized had a MW of approximately 1600 and was obtained from Oronite. The cyclic amide alkoxylate compound and detergent utilized for each formulation is set forth for the various tests in each table. Each component was used at the concentration indicated in ppm by weight. The tests employed are described below and the results of the various tests are set forth in the tables below.

Formulations

For the following formulations, all ppm by weight are based on the total weight of the fuel composition.

Formulation 1—Formulation 1 comprises 150 ppm by weight of PIB-EDA and 4000 ppm by weight of Compound A in regular unleaded gasoline.

Formulation 2—Formulation 2 comprises 150 ppm by weight of PIB-EDA and 2400 ppm by weight of Compound A in regular unleaded gasoline.

Formulation 3—Formulation 3 comprises 150 ppm by weight of PIB-EDA and 2400 ppm by weight of Compound A in premium unleaded gasoline.

Formulation 4—Formulation 4 comprises 350 ppm by weight of PIB-EDA and 3000 ppm by weight of Compound A in regular unleaded gasoline.

Formulation 5—Formulation 5 comprises 300 ppm by weight of PIB-EDA and 4800 ppm by weight of Compound B in regular unleaded gasoline.

Formulation 6—Formulation 6 comprises 200 ppm by weight of OGA-480 and 2400 ppm by weight of Compound A in regular unleaded gasoline.

Formulation 7—Formulation 7 comprises 300 ppm by weight of PIB-EDA and 4800 ppm by weight of Compound A in regular unleaded gasoline.

Formulation 8—Formulation 8 comprises 250 ppm by weight of PIB-EDA and 2500 ppm by weight of Compound A in regular unleaded gasoline.

Formulation 9—Formulation 9 comprises 150 ppm by weight of PIB-EDA and 4800 ppm by weight of Compound A in regular unleaded gasoline.

Comparative Formulations

For the following formulations, all ppm by weight are based on the total weight of the fuel composition.

Comparative Formulation A—150 ppm by weight PIB-EDA+300 ppm by weight Compound A in regular unleaded gasoline.

Comparative Formulation B—100 ppm by weight PIB-EDA+240 ppm by weight Compound A in regular unleaded gasoline.

Method For Octane Requirement Reduction

The purpose of octane requirement tests in engine dynamometer cells is to provide a method of determining the effect of various gasoline components and additives upon the octane requirement of the engine. Measurement of the effect of the induction system and combustion chamber deposits on octane requirement may also be performed.

Engines from vehicles are installed in dynamometer cells in such a way as to simulate road operation using a cycle of idle, low speed and high speed components while carefully controlling specific operating parameters.

Prior to testing, each engine is inspected and has its induction system cleaned. Parts are checked for excessive wear and a new oil filter, fuel filter, intake valves and spark plugs are installed.

Octane requirement reduction is a performance feature that demonstrates a reduction from the established octane requirement of a base gasoline in a given engine. The test need not start with a clean engine. The test protocol requires measurement of the octane requirement of an engine fueled with a base gasoline which generally consists of the test gasoline without additives or special treatment. However, the base gasoline may contain additives for a specific comparison. After reaching a stable octane requirement with the base gasoline, the engine is operated on test gasoline until the octane requirement again stabilizes. Rating intervals for test stands are typically twenty-four hours but for rapid octane requirement intervals of four hours were used. Test stand engines may be used to conduct several octane requirement reduction tests in sequence with the engine being restabilized on base gasoline between each test. A stable reduction of octane requirement from that of the base gasoline represents octane requirement reduction favorable to the test gasoline.

TABLE 1

OCTANE REQUIREMENT REDUCTION TESTING
The following tests were conducted according to the above-noted method. The engines used included a 1987 2.3 L Ford, 1988 2.3 L Olds, 1990 3.1 L Chevrolet, 1994 3.5 L Dodge and 1994 2.3 L Olds. The tests were conducted using the formulations indicated.

| Formulation # | Test Engine | Fuel | Additive Formulation in ppm by wt | Baseline Octane Requirement Minus Test Fuel Octane Requirement |
|---|---|---|---|---|
| 1 | 1987 2.3 L Ford | RU* | 150 PIB-EDA + 4000 Cmpd A | 4 |
| 2 | 1988 2.3 L Olds | RU* | 150 PIB-EDA + 2400 Cmpd A | 2.7 |
| 3 | 1988 2.3 L Olds | PU* | 150 PIB-EDA + 2400 Cmpd A | 2.3 |
| 4 | 1990 3.1 L Chev. | RU* | 350 PIB-EDA + 3000 Cmpd A | 5 |
| 5 | 1994 3.5 L Dodge | RU* | 300 PIB-EDA + 4800 Cmpd B | 5 |
| 6 | 1994 2.3 L Olds | RU* | 200 OGA-480 + 2400 Cmpd A | 5 |
| 7 | 1994 2.3 L Olds | RU* | 300 PIB-EDA + 4800 Cmpd A | 7 |
| 1 | 1987 2.3 L Ford | RU* | 150 PIB-EDA + 4000 Cmpd A | 4 |
| 2 | 1994 3.5 L Dodge | RU* | 150 PIB-EDA + 2400 Cmpd A | 3 |
| 8 | 1994 3.5 L Dodge | RU* | 250 PIB-EDA + 2500 Cmpd A | 8 |
| 5 | 1994 2.3 L Olds | RU* | 300 PIB-EDA + 4800 Cmpd B | 4 |

TABLE 1-continued

OCTANE REQUIREMENT REDUCTION TESTING
The following tests were conducted according to the above-noted method. The engines used included a 1987 2.3 L Ford, 1988 2.3 L Olds, 1990 3.1 L Chevrolet, 1994 3.5 L Dodge and 1994 2.3 L Olds. The tests were conducted using the formulations indicated.

| Formulation # | Test Engine | Fuel | Additive Formulation in ppm by wt | Baseline Octane Requirement Minus Test Fuel Octane Requirement |
|---|---|---|---|---|
| 7 | 1994 2.3 L Olds | RU* | 300 PIB-EDA + 4800 Cmpd A | 8 |
| 7 | 1994 3.5 L Dodge | RU* | 300 PIB-EDA + 4800 Cmpd A | 4 |

With regard to Table 1, the baseline fuel used, RU* or PU*, were regular and premium unleaded gasoline respectively, each containing a conventional inlet valve deposit control additive package (PIB-EDA + carrier fluid) at 100 ptb. The overall results indicate that the various formulations reduce octane requirement relative to the baseline fuel in the engine tests.

The data in Table 2 demonstrate the effectiveness of the additive concentrate at mega-dose levels.

TABLE 2

| Formulation | Fuel | Octane Requirement | Test Hours |
|---|---|---|---|
| Baseline Fuel (PIB-EDA + carrier fluid) | RU* | 90 | 2.2 |
| | | 91 | 21.2 |
| | | 92 | 43.7 |
| | | 93 | 68.8 |
| | | 98 | 142.2 |
| | | 95 | 162.9 |
| | | 95 | 186.5 |
| | | 95 | 210.4 |
| | | 94 | 232.9 |
| | | 98 | 309.9 |
| | | 99 | 332.1 |
| | | 98 | 353.7 |
| Comparison 1 (150 PIB-EDA + 300 Cmpd A) | RU* | 98 | 380.8 |
| | | 98 | 403.6 |
| | | 98 | 472.5 |
| | | 98 | 496.8 |
| | | 97 | 520.7 |
| | | 98 | 544.5 |
| | | 97 | 567.2 |
| | | 96 | 647 |
| Formulation 9 (150 PIB-EDA + 4800 Cmpd A) | RU* | 93 | 651 |
| | | 92 | 655 |

With regard to Table 2, the regular unleaded gasoline (RU*) containing a conventional inlet valve deposit control additive package (PIB-EDA + carrier fluid) at 100 ptb was used.

In Table 2, the test was performed in a 2.3 L Olds. The engine was prepared as noted above. The engine was operated on baseline gasoline (regular unleaded gasoline containing PIB-EDA+carrier fluid at 100 ptb) until a stable engine octane requirement was obtained (at approximately 353 hours). At this time, the engine was switched to baseline gasoline which contained Comparative Formulation A (150 ppm by weight PIB-EDA+300 ppm by weight Compound A). This resulted in a octane requirement reduction of 2 (98 minus 96) over a period of approximately 293 hours. The engine was then switched to baseline gasoline+Formulation 9 (150 PIB-EDA+4800 Compound A). This resulted in an octane requirement reduction of 4 over a period of 8 hours. The results of this test clearly indicate that mega-doses of the additive concentrate of the present invention show a substantial reduction in octane requirement over a rapid or short period of time compared to formulations which contain lower dosages.

The data in Table 3 further demonstrate the effectiveness of the additive concentrate at mega-dose levels.

TABLE 3

| Formulation | Fuel | Octane Requirement | Test Hours |
|---|---|---|---|
| Baseline Fuel (PIB-EDA + Carrier Fluid) | RU* | 86 | 1 |
| | | 88 | 22 |
| | | 88 | 40 |
| | | 89 | 65 |
| | | 91.5 | 138 |
| | | 92 | 162 |
| | | 94 | 189 |
| | | 95 | 208 |
| | | 96 | 231 |
| | | 97 | 303 |
| | | 97 | 373 |
| Formulation 7 (300 PIB-EDA + 4800 Cmpd A) | RU* | 94 | 377 |
| | | 94 | 381 |
| Comparison B (100 PIB-EDA + 240 Cmpd A) | RU* | 93 | 397 |
| | | 90 | 470 |
| | | 89 | 489 |
| | | 89 | 511 |

With regard to the above Table, the regular unleaded gasoline (RU*) containing a conventional inlet valve deposit control additive package (PIB-EDA + carrier fluid) at 100 ptb was used.

In Table 3, the test was performed in a 2.3 L Ford. The engine was prepared as noted above. The engine was operated on baseline gasoline (regular unleaded gasoline containing PIB-EDA+carrier fluid at 100 ptb) until a stable engine octane requirement was obtained (at approximately 373 hours). At this time, the engine was switched to baseline gasoline which contained Formulation 7 (300 PIB-EDA+4800 Compound A). This resulted in a octane requirement reduction of 3 (97 minus 94) over a period of approximately 8 hours. The engine was then switched to baseline gasoline+Comparative Formulation B (100 ppm by weight PIB-EDA+240 ppm by weight Compound A). This resulted in an octane requirement reduction of 5 over a period of approximately 130 hours. The results of this test again indicate that mega-doses of the additive concentrate of the present invention show a substantial reduction in octane requirement over a rapid or short period of time compared with formulations which contain lower dosages.

In addition, the detergents used in these experiments did not interfere with the reduction for octane requirement.

What is claimed is:

1. An additive concentrate, for adding to a fuel comprising a mixture of hydrocarbons boiling in the gasoline boiling range for reducing octane requirement in an internal combustion engine, said additive composition comprising:

a cyclic amide alkoxylate of the general formula:

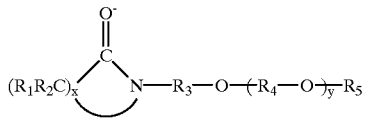

wherein x is from 3 to 11; y is from 1 to 50; $R_1$ and $R_2$ are independently selected from hydrogen, hydrocarbyl of 1 to 100 carbon atoms or substituted hydrocarbyl of 1 to 100 carbon atoms; $R_3$ is selected from hydrocarbyl of 1 to 100 carbon atoms and substituted hydrocarbyl of 1 to 100 carbon atoms; each $R_4$ is independently selected from hydrocarbyl of 2 to 100 carbon atoms and substituted hydrocarbyl of 2 to 100 carbon atoms; $R_5$ is hydrogen, hydrocarbyl of 1 to 100 carbon atoms or acyl of 1 to 20 carbon atoms;

a detergent selected from polyalkylenylamines, Mannich amines, polyalkenylsuccinimides, poly(oxyalkylene) carbamates, and poly(alkenyl)-N-substituted carbamates; and a solvent selected from aromatic solvents, paraffinic solvents, naphthenic solvents and mixtures thereof, wherein the ratio of cyclic amide alkoxylate to detergent is from 1:1.1 to 60:1 so that when the additive concentrate is added to the fuel, the cyclic amide alkoxylate is present in an amount of 1100 to 6000 ppm by weight and the detergent is present in an amount of from 100 to 1000 ppm by weight based on the total weight of the resulting composition.

2. The additive concentrate of claim 1 wherein $R_1$ and $R_2$ are each independently selected from hydrogen and alkyl of 1 to 20 carbon atoms; $R_3$ is alkyl of 2 to 10 carbon atoms; each $R_4$ is independently selected from hydrocarbyl of 2 to 20 carbon atoms; x is 3, 5 or 11; and y is from 8 to 40.

3. The additive concentrate of claim 2 wherein $R_1$, $R_2$ and $R_5$ are each hydrogen.

4. The additive concentrate of claim 2 wherein $R_3$ is alkyl of 2 to 4 carbon atoms and each $R_4$ is independently alkyl of 2 to 4 carbon atoms.

5. The additive concentrate of claim 2 wherein y is from 18 to 24.

6. The additive concentrate of claim 2 wherein $R_4$ is hydrocarbyl of the formula

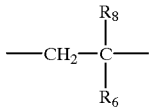

wherein each $R_6$ is independently selected from hydrogen and alkyl of 1 to 18 carbon atoms and each $R_8$ is independently selected from hydrogen and alkyl of 1 to 18 carbon atoms.

7. The additive concentrate of claim 2 wherein the detergent is polylkylenylamine selected from PIB-DAP, PIB-EDA and mixtures thereof.

8. A fuel composition comprising a mixture of a major amount of hydrocarbons in the gasoline boiling range and an additive concentrate comprising a cyclic amide alkoxylate having the general formula:

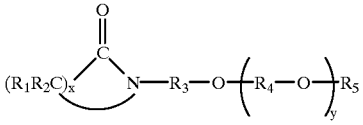

wherein x is from 3 to 11; y is from 1 to 50; $R_1$ and $R_2$ are independently selected from hydrogen, hydrocarbyl of 1 to 100 carbon atoms or substituted hydrocarbyl of 1 to 100 carbon atoms; $R_3$ is selected from hydrocarbyl of 1 to 100 carbon atoms and substituted hydrocarbyl of 1 to 100 carbon atoms; each $R_4$ is independently selected from hydrocarbyl of 2 to 100 carbon atoms and substituted hydrocarbyl of 2 to 100 carbon atoms; $R_5$ is hydrogen, hydrocarbyl of 1 to 100 carbon atoms or acyl of 1 to 20 carbon atoms;

a detergent selected from polyalkylenylamines, Mannich amines, polyalkenylsuccinmides, poly(oxyalkylene) carbamates, and poly(alkenyl)-N-substituted carbamates; and a solvent selected from aromatic solvents, paraffinic solvents, naphthenic solvents and mixtures thereof; wherein the cyclic amide alkoxylate is present in an amount from 1100 to 6000 ppm by weight based on the total weight of the fuel composition and the detergent is present in an amount from 100 to 1000 ppm by weight based on the total weight of the fuel composition.

9. The fuel composition of claim 8 wherein $R_1$ and $R_2$ are each independently selected from hydrogen and alkyl of 1 to 20 carbon atoms; $R_3$ is alkyl of 2 to 10 carbon atoms; each $R_4$ is independently selected from hydrocarbyl of 2 to 20 carbon atoms; x is 3, 5 or 11; and y is from 8 to 40.

10. The fuel composition of claim 9 wherein $R_1$, $R_2$ and $R_5$ are each hydrogen.

11. The fuel composition of claim 9 wherein $R_3$ is alkyl of 2 to 4 carbon atoms and each $R_4$ is independently alkyl of 2 to 4 carbon atoms.

12. The fuel composition of claim 9 wherein y is from 18 to 24.

13. The fuel composition of claim 9 wherein $R_4$ is hydrocarbyl of the formula

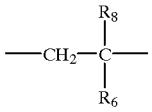

wherein each $R_6$ is independently selected from hydrogen and alkyl of 1 to 18 carbon atoms and each $R_8$ is independently selected from hydrogen and alkyl of 1 to 18 carbon atoms.

14. The fuel composition of claim 9 wherein the detergent is polylkylenylamine selected from PIB-DAP, PIB-EDA and mixtures thereof.

15. A method for reducing octane requirement in an internal combustion engine which comprises burning in said engine a fuel composition comprising a mixture of a major amount of hydrocarbons in the gasoline boiling range and an additive concentrate comprising a cyclic amide alkoxylate of the general formula:

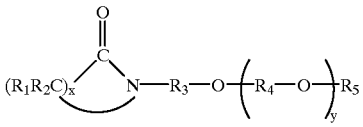

wherein x is from 3 to 11; y is from 1 to 50; $R_1$ and $R_2$ are independently selected from hydrogen, hydrocarbyl of 1 to 100 carbon atoms or substituted hydrocarbyl of 1 to 100 carbon atoms; $R_3$ is selected from hydrocarbyl of 1 to 100 carbon atoms and substituted hydrocarbyl of 1 to 100 carbon atoms; each $R_4$ is independently selected from hydrocarbyl of 2 to 100 carbon atoms and substituted hydrocarbyl of 2 to 100 carbon atoms; $R_5$ is hydrogen, hydrocarbyl of 1 to 100 carbon atoms or acyl of 1 to 20 carbon atoms;

a detergent selected from polyalkylenylamines, Mannich amines, polyalkenylsuccinimides, poly(oxyalkylene) carbamates, and poly(alkenyl)-N-substituted carbamates; and a solvent selected from aromatic solvents, paraffinic solvents, naphthenic solvents and mixtures thereof; wherein the cyclic amide alkoxylate is present in an amount from 1100 to 6000 ppm by weight based on the total weight of the fuel composition and the detergent is present in an amount from 100 to 1000 ppm by weight based on the total weight of the fuel composition.

16. The method of claim 15 wherein $R_1$ and $R_2$ are each independently selected from hydrogen and alkyl of 1 to 20 carbon atoms; $R_3$ is alkyl of 2 to 10 carbon atoms; each $R_4$ is independently selected from hydrocarbyl of 2 to 20 carbon atoms; x is 3, 5 or 11; and y is from 8 to 40.

17. The method of claim 16 wherein $R_1$, $R_2$ and $R_5$ are each hydrogen.

18. The method of claim 16 wherein $R_3$ is alkyl of 2 to 4 carbon atoms and each $R_4$ is independently alkyl of 2 to 4 carbon atoms.

19. The method of claim 16 wherein y is from 18 to 24.

20. The method of claim 16 wherein $R_4$ is hydrocarbyl of the formula

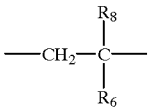

wherein each $R_6$ is independently selected from hydrogen and alkyl of 1 to 18 carbon atoms and each $R_8$ is independently selected from hydrogen and alkyl of 1 to 18 carbon atoms.

21. The method of claim 16 wherein the detergent is polylkylenylamine selected from PIB-DAP, PIB-EDA and mixtures thereof.

* * * * *